United States Patent [19]

Arieh et al.

[11] Patent Number: 4,893,419

[45] Date of Patent: Jan. 16, 1990

[54] REAR-FITTING SHELL-TYPE SKI BOOT

[75] Inventors: Simon Arieh, Geneva; Guy Courvoisier, Celigny, both of Switzerland

[73] Assignee: Lange International S.A., Switzerland

[21] Appl. No.: 218,639

[22] Filed: Jul. 13, 1988

[30] Foreign Application Priority Data

Sep. 9, 1987 [CH] Switzerland ..... 3491/87

[51] Int. Cl.[4] ..... A43B 5/04; A43C 11/00

[52] U.S. Cl. ..... 36/119; 36/50

[58] Field of Search ..... 36/117–121, 36/50, 105; 24/685 K

[56] References Cited

U.S. PATENT DOCUMENTS 4,408,403 10/1983 Martin ..... 36/117 X
4,677,768 1/1987 Benoit et al. ..... 36/117
4,694,592 9/1987 Baggio et al. ..... 36/117
4,711,042 12/1987 Morell et al. ..... 36/50
4,748,751 6/1988 Sartor ..... 36/119
4,765,069 8/1988 Baggio et al. ..... 36/50

FOREIGN PATENT DOCUMENTS 0146502 6/1985 European Pat. Off. ..... 36/119

*Primary Examiner*—James Kee Chi
*Attorney, Agent, or Firm*—Kane, Dalsimer, Sullivan, Kurucz, Levy, Eisele and Richard

[57] ABSTRACT

The boot is equipped at the rear with a cable-type clamping and closing device consisting of a lever (9) mounted on a support piece (10) displaceable on a rack (11). This rack is preferably movable and connected to two cables (23, 24) for clamping the foot, the upper (4) being closed and clamped by a cable (17) attached to the tensioning lever (9) and acting on the rack in a direction opposite to that of the other cables (23, 24).

4 Claims, 6 Drawing Sheets

Fig.6
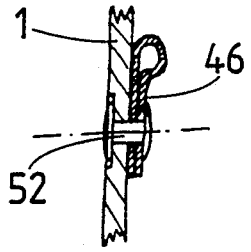
Fig.7
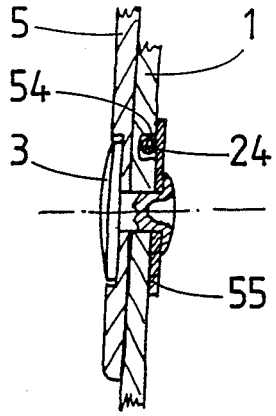
Fig.8
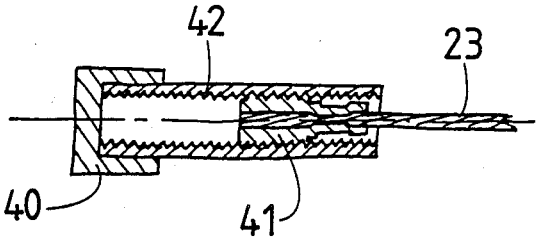
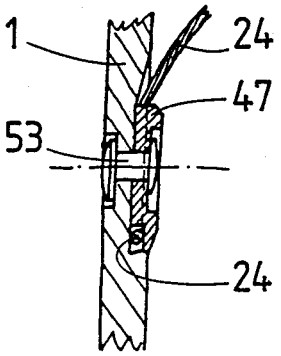
Fig.9

REAR-FITTING SHELL-TYPE SKI BOOT

FIELD OF THE INVENTION

The present invention relates to a rear-fitting shell-type ski boot comprising a rigid bottom shell and a two-part upper consisting of a front part and a rear part hinged on the bottom shell and on which there is mounted a tensioning device operating in a vertical plane and acting on at least one pulling cable of a closing and/or clamping means by means of a tensioning lever hinged on a support piece.

PRIOR ART

The patent EP 0,113,908 describes a rear-fitting boot provided with a tensioning lever hinged on a support piece, the position of which can be adjusted, and acting on a single cable exerting a diagonal clamping action on the foot. The tensioning lever can be pivoted upwards. The same document also describes a tensioning lever mounted on a fixed support piece and acting on two cables clamping simultaneously the heel and instep. The lever can be pivoted downwards.

A boot comprising at the rear a tensioning lever acting on a cable closing the upper of the boot at the top is also known from the patent FR 2,556,189 (U.S. Pat. No. 4,596,080).

The patent U.S. Pat. No. 4,539,763 also discloses a boot provided at the rear with a lever which can be pivoted upwards and which pulls a cable clamping the instep diagonally.

In the known boots, the length of cable released when the tensioning lever is opened is determined by the distance between the point where the cable is attached to the tensioning lever and the hinging axis of this tensioning lever. Although this length of cable is usually sufficient for clamping and unclamping the foot, on the other hand it is not enough to allow the boot to be opened wide when the cable is used for closing the upper of the boot and clamping the latter. In order to increase this cable length, the attachment point of the cable must be moved towards the end of the tensioning lever, which has the effect of eliminating the leverage effect of the latter, without mentioning the considerable loss of tension in the cable after the tensioning lever has passed through a maximum tensioning point when it is being closed. This maximum tension may be particularly difficult to overcome when opening the tensioning lever.

SUMMARY OF THE INVENTION

The object of the present invention is to increase considerably the degree of relaxation of the cable without increasing the radius of the attachment point of the tensioning-lever cable and, on the contrary, using a relatively small radius enabling the leverage effect of the tensioning lever to be fully exploited.

The boot according to the invention is characterized in that the support piece of the tensioning lever is slidably mounted on a rack with ratchet teeth, on which it is retained by a pawl against the pulling action of the cable connected to the tensioning lever, the pawl being kept engaged with the rack by a spring and having an arm by means of which it may be separated manually from the rack.

In the closing direction, the pawl of the tensioning-lever support piece jumps over the ratchet teeth of the rack,while allowing the tensioning-lever support piece to slide along the rack pulling the cable with it. The tensioning-lever support piece stops on its own when it encounters a certain amount of resistance from the cable. It is then sufficient to close the tensioning lever in order to complete the clamping operation. Conversely, the user may displace the tensioning-lever support piece in the other direction, freeing it from the rack by pressure on the arm of the pawl. This design is particularly advantageous when the tensioning lever is used to close and clamp the upper of the boot because, in this case, a considerable length of cable may be released, thereby enabling the boot to be opened wide.

According to a preferred embodiment of the invention, the tensioning lever acts directly on a cable closing and clamping the upper of the boot and is mounted on a rack which itself slides and the end of which opposing the pulling force on the cable for closing the upper is connected to at least a second cable used to clamp the foot. Since clamping of the foot requires only a relatively small movement of the cable, the retraction of the rack, preferably limited by a stop, which avoids displacement of the attachment point of the cable for closing the upper, is entirely acceptable.

BRIEF DESCRIPTION OF THE DRAWINGS

The accompanying drawing shows, by way of an example, an embodiment of the invention.

FIGS. 6 to 9 are detailed views, in section, of the holes for the cable fixtures shown in FIG. 5.

DESCRIPTION OF THE PREFERRED EMBODIMENT(S)

Figure 1:
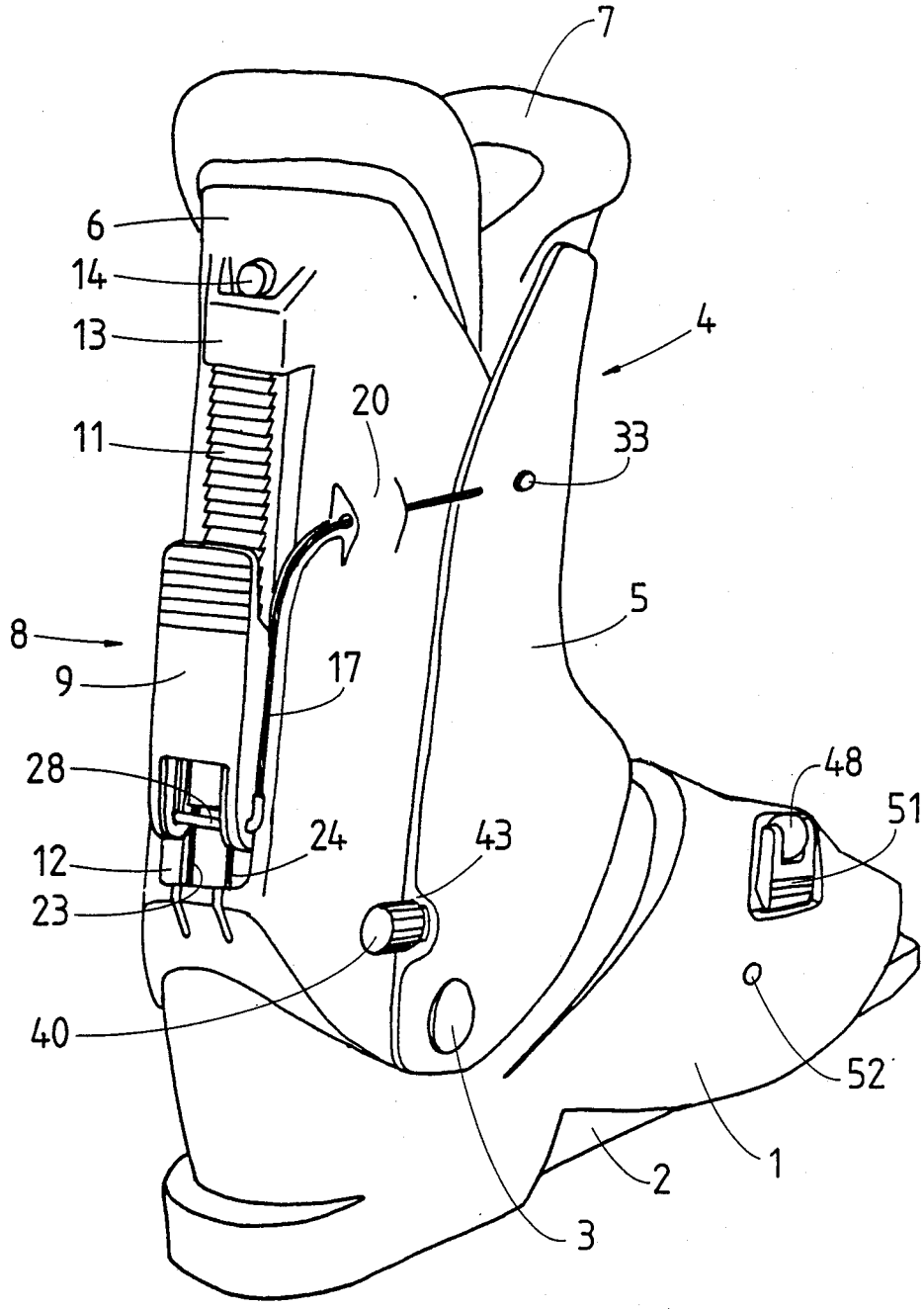
FIG. 1 shows a perspective view of a closed right-hand boot.
Figure 2:
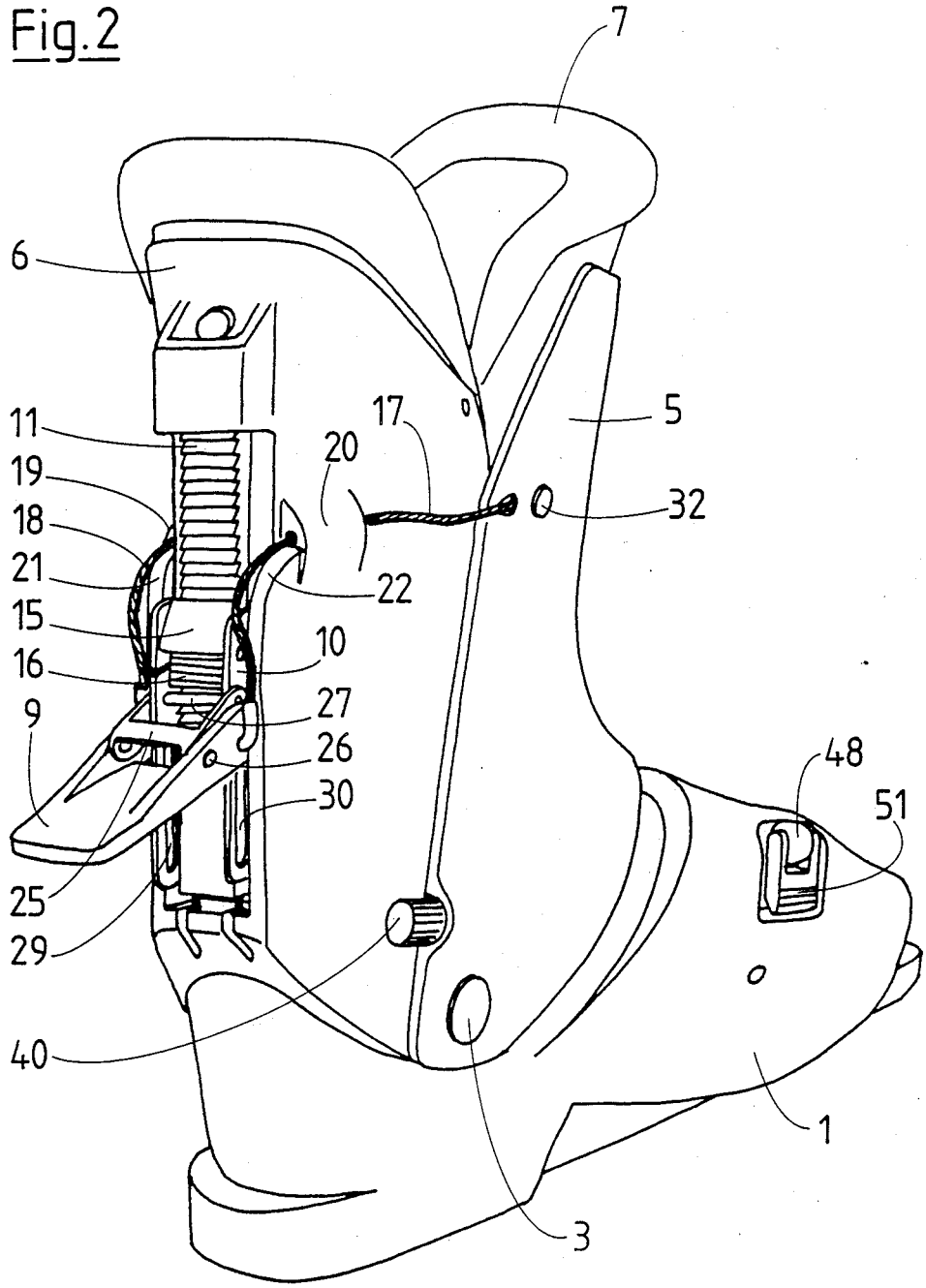
FIG. 2 shows the same boot in the released position.

The boot will first of all be described as visible externally in FIGS. 1 and 2. It comprises a rigid bottom shell 1 formed as one piece with the sole 2 according to a usual design. An upper 4 having a front channel-shaped part 5 inside which a rear part 6 fits is hinged on this bottom shell 1 at a point 3. The boot is equipped, in addition, with a slipper or inner shoe 7 intended to ensure that the foot is comfortable inside the boot. A tensioning device 8 is mounted at the back of this boot, on the rear part 6 of the upper and acts simultaneously on the upper 4 so as to close it and on the foot so as to clamp it. This device 8 consists essentially of a tensioning lever 9 hinged on a support piece 10 (FIG. 2) in the form of U-shaped part itself mounted a rack 11 with ratchet teeth directed towards the bottom of the boot. The rack 11 is not fixed to the boot, but is movable vertically and simply guided at the bottom by a groove 12 and at the top by a bridge 13. Its movement, however, is limited at the top by a stop 14 and at the bottom by the end of the groove 12. The support piece 10 of the lever 9 is retained on the rack 11 by a pawl 15 hinged between the flanges of the support piece 10, the rack 11 therefore passing between the pawl 15 and the base of the support piece 10. The pawl 15 is provided with an arm 16 enabling it to be manually separated from the rack 11. The ends of two cables 17 and 18 passing into two guides 19 and 20 formed on the rear part 6 of the upper are attached to the tensioning lever 9, the other ends of these cables being fixed to front part 5 of the upper by studs 32 and 33. The rear part 6 of the upper has, in addition, rounded shoulders 21 and 22 for guiding the cables 17 and 18. The ends of two cables 23 and 24 for clamping the instep and foot are attached to the bottom end of the rack 11.

The closing and tensioning device 8 will be described in more detail with the aid of FIG. 3. The tensioning lever 9 is not hinged directly on the support piece 10, but via a connecting piece 25 hinged with the tensioning lever 9 at 26 and with the support piece 10 by a pin 27. One end of the tensioning lever 9 is, moreover, provided with a pin 28 capable of moving inside two slots 29 and 30 in the support piece 10, substantially parallel to the rack 11. The pin 27, moreover, serves as an attachment point for the ends of the cables 17 and 18. It should be noted that the cables 17 and 18 could consist of a single cable passing through the pin 28. The pawl 15 is hinged on the support piece 10 by means of a pin 31 and a catch spring 56 mounted about this pin 31 keeps the tip of the pawl engaged with the teeth of the rack 11. In the closed position (FIG. 3), the pawl 15 is covered by the tensioning lever 9. In the released position (FIG. 2) and in the open position (FIG. 4), on the other hand, the pawl 15 and its operating arm 16 are exposed.

Before describing the mode of operation of the closing device, the arrangement of the cables will be described. That of the cables 17 and 18 has already been described.

Figure 3:
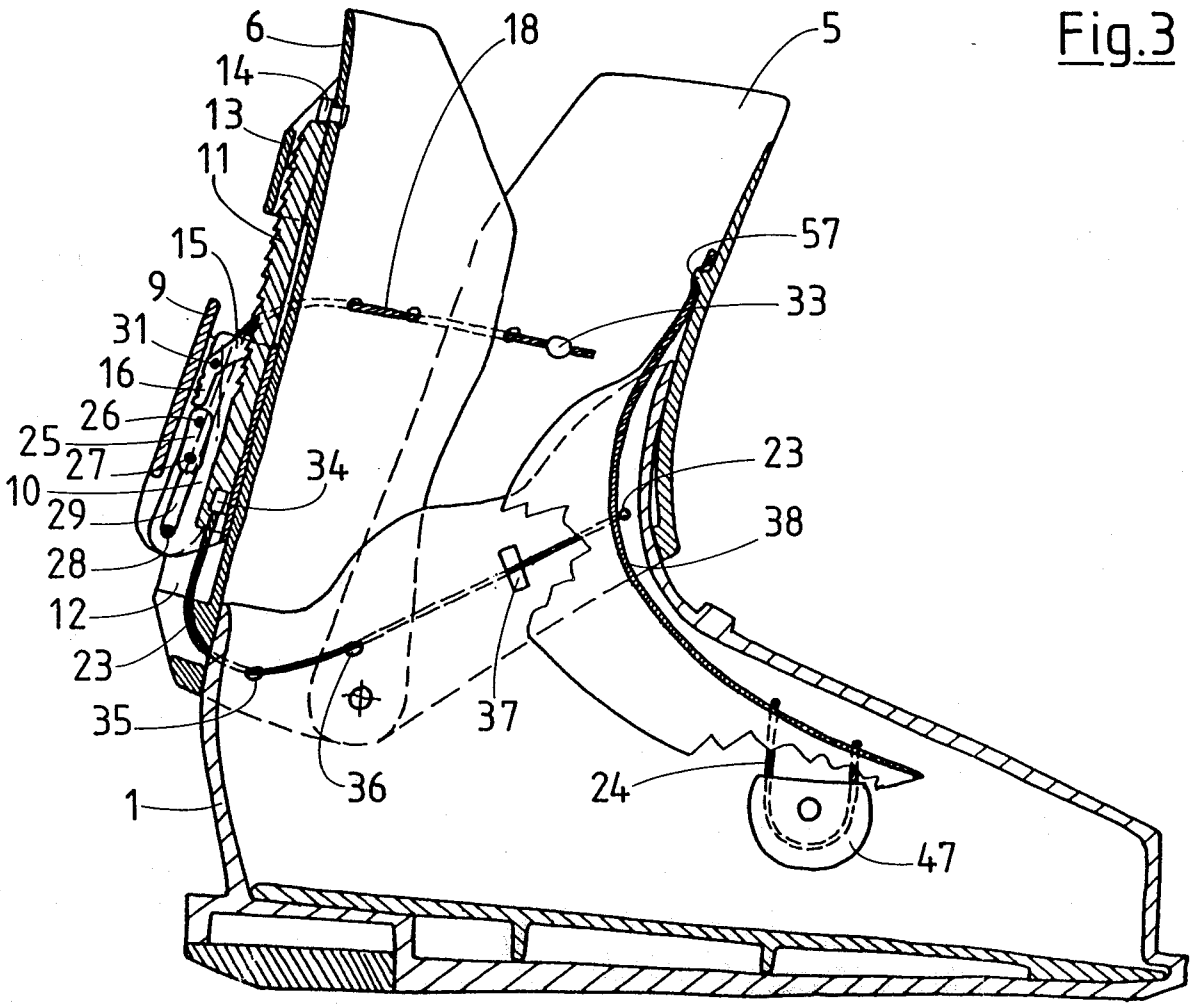
FIG. 3 is a vertical longitudinal section through the right-hand boot shown in FIG. 1, in the closed and clamped position.

The cable 23 is provided at the rear with a head 34 by means of which it is retained inside a recess in the rack 11 (FIG. 3). It then passes over a rounded part of the upper 4 and then enters the bottom shell 1 via a hole 35, emerges from it laterally via a hole 36 and enters again the inside of the bottom shell 1 via an aperture 37, then passes over a pressure distributor consisting of a plate 38 in the form of a horse saddle, well known per se and serving to distribute the pressure of the cable over the instep and the foot. The pressure distributor 38 is fixed at its upper end to an internal nipple 57 on the front part 5 of the upper. The cable 23 then emerges again from the bottom shell 1 via an aperture 39 (FIG. 4) and its end is anchored laterally to the front part 5 of the upper by a cable end-piece 40 which allows the attachment point of the cable to be modified relative to the front part 5 of the upper. This device is shown in FIG. 8. It comprises a threaded core 41 fixed to the cable 23 and mounted inside a tapped tube 42 integral with the end-piece 40 which is spring-loaded and bears against a bearing surface 43 on the upper (FIG. 1). Rotation of the end-piece 40 has the effect of displacing the core 41 and consequently modifying the point where the cable 23 is anchored to the upper.

Figure 4:
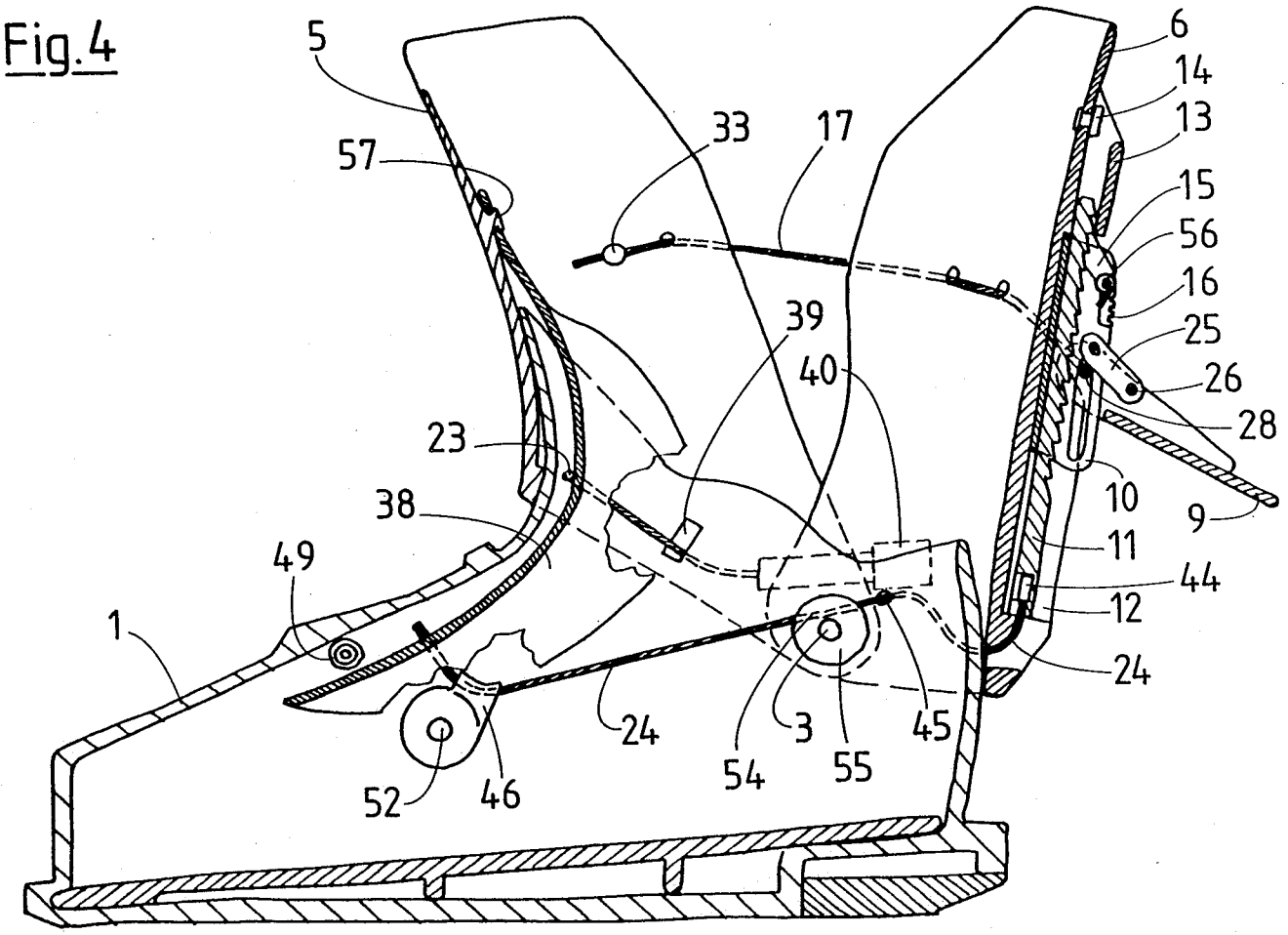
FIG. 4 is a longitudinal vertical section through the same right-hand boot in the open position, showing the other side of the boot.
Figure 5:
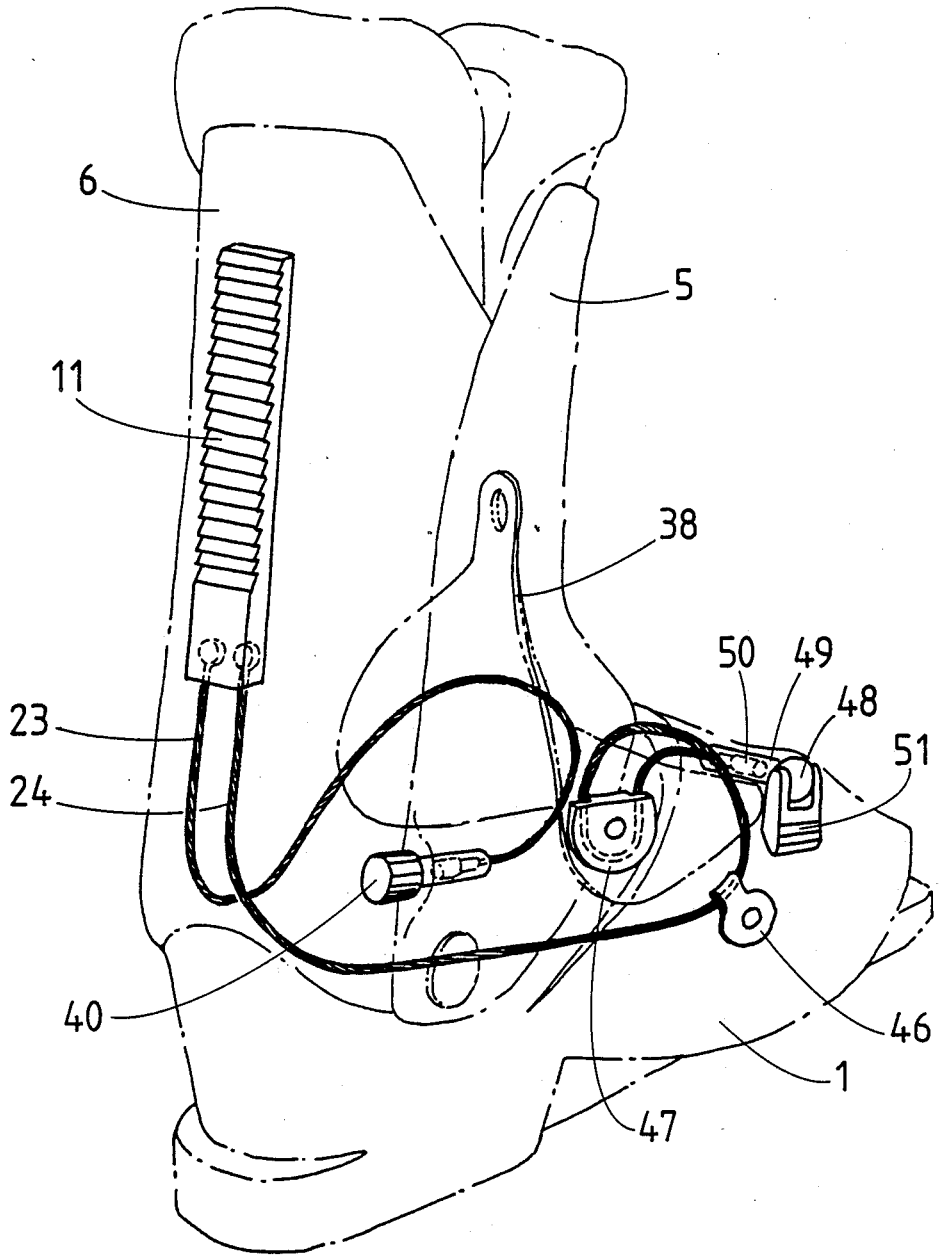
FIG. 5 shows the layout of the cables for clamping the foot inside the boot, which is shown transparent.

As for the cable 24, it is also attached at one end to the rack 11 by a cable head 44 in the same manner as the cable 23 (FIG. 4). The cable 24 is first of all guided parallel to the cable 23, then it enters into the bottom shell 1 via a hole 45, passes into a guide 54, then into a deflector 46 fixed to the wall of the shell bottom 1 and then over the pressure distributor 38. It then passes over a second deflector 47 (FIG. 3) fixed to the opposite wall of the bottom shell 1 and then passes over the pressure distributor 38 again, its end being finally attached to a cable end-piece 48 similar to the cable end-piece 40 and bearing against the bottom shell 1. The arrangement of the cables is shown particularly clearly in FIG. 5. The cable head-piece 48 also comprises a tapped tube 49 inside which a threaded core 50 integral with the cable 24 is mounted. The tube 49 may be made to rotate by a grip 51 which is hinged with the end-piece 48 and can be flipped down inside a recess provided in a thicker portion of the bottom shell 1.

The deflector 46 is shown sectioned in FIG. 6. It consists of a folded piece of sheet metal fixed to the bottom shell 1 by a rivet 52.

The deflector 47 is shown sectioned in FIG. 9. It consists of a small plate fixed to the bottom shell 1 by a rivet 53 and having a semi-circular bearing surface for guiding the cable 24.

The guide 54 is shown in FIG. 7, which is a section through the hinging arrangement of the upper on the bottom shell at the point where the cable 24 passes through. The guide 54 consists of a groove formed in the thickness of the bottom shell 1 and closed by a washer 55.

The device 8 therefore ensures simultaneously that the boot is closed and the foot is clamped. The mode of operation of the device will be described on the basis of FIG. 4 which shows the boot in the open position. In this position, the support piece 10 of the tensioning lever 9 is in the upper part of the rack 11. The tensioning lever 9 is open and its pin 28 to which the cables 17 and 18 are attached bears against the upper ends of the slots 29 and 30. In this position, the cables 17 and 18 are fully released, thereby enabling the boot to be opened wide by tilting backwards the rear part of the upper 6. The rack 11 is not under tension and the cables 23 and 24 are also released. In order to close the boot, the skier lifts the tensioning lever 9, which has the effect of pulling the cables 17 and 18 and closing the upper of the boot. When the tensioning lever 9 reaches an oblique position, towards the top, an axial force on the lever 9 has the effect of causing the support piece 10 to move along the rack 11, the pawl 15 jumping over the teeth on this rack. When the tension of the cables is such that it is no longer possible to push the support piece 10, it only remains to press down the lever 9 completely against the boot so as to tension all the cables, the tension of the cables 23 and 24 being ensured by the pulling force on the rack exerted by the reaction on the cables 17 and 18. The force with which the upper is clamped is generally greater than that with which the foot is clamped. This is why the movement of the rack 11, and consequently the tension on the cables 23 and 24, is limited by the stop 14. The foot is clamped in a particularly effective manner owing to the fact that the cables 23 and 24 exert a pressure on the pressure distributor 38 at three different points.

If the skier wishes to loosen his boot, without however removing it, it is sufficient for him to open the tensioning lever 9 as shown in FIG. 2. In this position, all the cables are released, but the support piece 10 has not moved on the rack 11 so that the tension setting is retained. The skier needs merely to close the lever 9 again in order to revert to the previous conditions for skiing.

In order to remove the boot, the user simply has to press on the arm 16 of the pawl 15 so as to release it from the rack 11 and at the same time pull the lever 9 upwards so as to cause the support piece to move towards the top of the rack 11, back into the position shown in FIG. 4.

The embodiment shown is particularly advantageous for at least two reasons. First of all, since the tensioning lever 9 is closed at the top, in the maximum clamping position, it protrudes by only a very small amount beyond the rack 11, thereby ensuring that the international standards relating to the space which must be left free above the heel are met. Furthermore, since the cables 17 and 18 are attached to the point where the tensioning lever 9 rotates on its support piece 10, the tension of the cables increases continuously until the tensioning lever 9 is completely closed, something which would not be the case if a simple lever were used, without the connecting piece 25 and a point for attaching the cable 17 and 18 to the tensioning lever located between its hinging axis and its end.

According to a variation not shown and selfevident, it would of course be possible to use a tensioning lever having a single hinging axis on its support piece and closing from the top downwards. In an even more simplified embodiment, without clamping of the foot, the rack 11 could be fixed. However, in this case one would already have the advantage of a sliding support piece for the tensioning lever, ensuring that the cables 17 and 18 are released more fully, while the attachment points of the tensioning-lever cables would have a smaller radius of gyration, i.e. optimum use would be made of the leverage effect of the tensioning lever.

The rack 11 may of course be made of synthetic material.

We claim:

1. Rear-fitting shell-type ski boot comprising a rigid bottom shell (1) and a two-part upper consisting of a front part (5) and a rear part (6) hinged on the bottom shell and on which there is mounted a tensioning device (8) operating in a vertical plane and acting on at least one pulling cable (17, 18, 23, 24) of a closing and/or clamping means by means of a tensioning lever (9) hinged on a support piece (10), wherein the support piece (10) of the tensioning lever is slidably mounted on a rack with ratchet teeth (11) on which it is retained by a pawl (15) against the pulling action of the cable (17, 18) connected to the tensioning lever, the pawl being kept engaged with the rack by a spring and having an arm (16) by means of which it may be separated manually from the rack.

2. Ski boot as claimed in claim 1, wherein the rack (11) is itself movable axially and is connected to at least a second pulling cable (23, 24) of a foot clamping means acting in the direction opposite to that of the first cable (17, 18).

3. Ski boot as claimed in claim 2, wherein the tensioning lever (9) can be pivoted back towards the top of the boot and is hinged, on the one hand, at a middle point (26) with the end of a connecting piece or a pair of connecting pieces (25), the other end of which is hinged on the support piece (10), and, on the other hand, at one end, inside a slot (29, 30) substantially parallel to the rack, inside which this end is able to slide, the first cable (17, 18) being attached to the lever at a point situated between the two hinging points of the lever.

4. Ski boot as claimed in either of claims 2 or 3, wherein one of the ends of the cable or of the two cables (23, 24) is fixed to the rack (11) and the other end of this cable or these cables is fixed to a threaded core (41, 50) mounted inside a tapped sleeve (42, 49) retained axially at a point on the shell and provided with visible rotating means (40, 51) for adjusting the effective length of the cable(s).

* * * * *